US012715729B2

(12) United States Patent
Huang et al.

(10) Patent No.: US 12,715,729 B2
(45) Date of Patent: Aug. 25, 2026

(54) REELING DEVICE

(71) Applicant: Taiwan Semiconductor Manufacturing Company, Ltd., Hsinchu (TW)

(72) Inventors: Chih-Hung Huang, Hsinchu (TW); Cheng-Lung Wu, Zhunan Township (TW); Yang-Ann Chu, Hsinchu City (TW); Jiun-Rong Pai, Jhubei City (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 90 days.

(21) Appl. No.: 18/788,491

(22) Filed: Jul. 30, 2024

(65) Prior Publication Data

US 2024/0383720 A1 Nov. 21, 2024

Related U.S. Application Data

(63) Continuation of application No. 17/446,406, filed on Aug. 30, 2021, now Pat. No. 12,084,307.

(51) Int. Cl.

| | |
|---|---|
| ***B65H 75/44*** | (2006.01) |
| ***B65H 16/02*** | (2006.01) |
| ***B65H 18/08*** | (2006.01) |
| ***B65H 20/02*** | (2006.01) |

(52) U.S. Cl.

CPC ..... *B65H 75/44* (2013.01); *B65H 16/02* (2013.01); *B65H 18/08* (2013.01); *B65H 20/02* (2013.01)

(58) Field of Classification Search

CPC ..... B65H 75/44; B65H 16/02; B65H 18/08; B65H 20/02; B65H 2701/11332; B65H 18/103; B65H 2701/1942; B65H 18/023; B65H 18/10; B65H 18/06; B65H 23/0324; B65H 19/2276

See application file for complete search history.

(56) References Cited

U.S. PATENT DOCUMENTS

| | | | | |
|---|---|---|---|---|
| 3,567,147 | A | 3/1971 | Engelsmann et al. | |
| 4,166,588 | A | 9/1979 | Krehbiel et al. | |
| 4,221,481 | A | 9/1980 | Savarick | |
| 4,494,706 | A | 1/1985 | Becherer et al. | |
| 4,504,026 | A | 3/1985 | Serizawa et al. | |
| 4,784,345 | A | 11/1988 | Romanowski et al. | |
| 6,814,325 | B2 | 11/2004 | Kamoda | |
| 6,820,831 | B2 | 11/2004 | Yamasaki | |
| 12,084,307 | B2 * | 9/2024 | Huang | B65H 75/44 |
| 2023/0064612 | A1 | 3/2023 | Huang et al. | |

* cited by examiner

*Primary Examiner* — William A. Rivera
(74) *Attorney, Agent, or Firm* — Harrity & Harrity, LLP

(57) ABSTRACT

In some implementations, a reeling device may receive material via a receiving end of a set of guiding blocks positioned around a reel. The set of guiding blocks are configured with an opening at the receiving end and with one or more inner surfaces configured to guide the material on a path around a surface of the reel. The one or more inner surfaces of the set of guiding blocks are arc-shaped to generally follow the surface of the reel. The reeling device may operate a motor that rotates the reel in a loading direction to facilitate loading the material onto the reel. The set of guiding blocks travel generally away from the surface of the reel based on the material being received and/or the motor operating in the loading direction.

20 Claims, 9 Drawing Sheets

REELING DEVICE

RELATED APPLICATION

This application is a continuation of U.S. patent application Ser. No. 17/446,406, filed Aug. 30, 2021, which is incorporated herein by reference in its entirety.

BACKGROUND

An automated optical inspection (AOI) tool may be configured to receive tape from a loaded reel (e.g., a source reel, or a tape and reel device, among other examples). The loaded reel may deliver components (e.g., integrated circuits (ICs)) for inspection via the AOI tool. The loaded reel may be configured with tape loaded onto (e.g., wound around) the loaded reel, such that when the tape is unloaded (e.g., unwound), the tape delivers components along a linear path for inspection via the AOI tool. After inspection via the AOI tool, an inspected portion of the tape may be stored by winding the inspected portion of the tape around another reel farther along the linear path.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
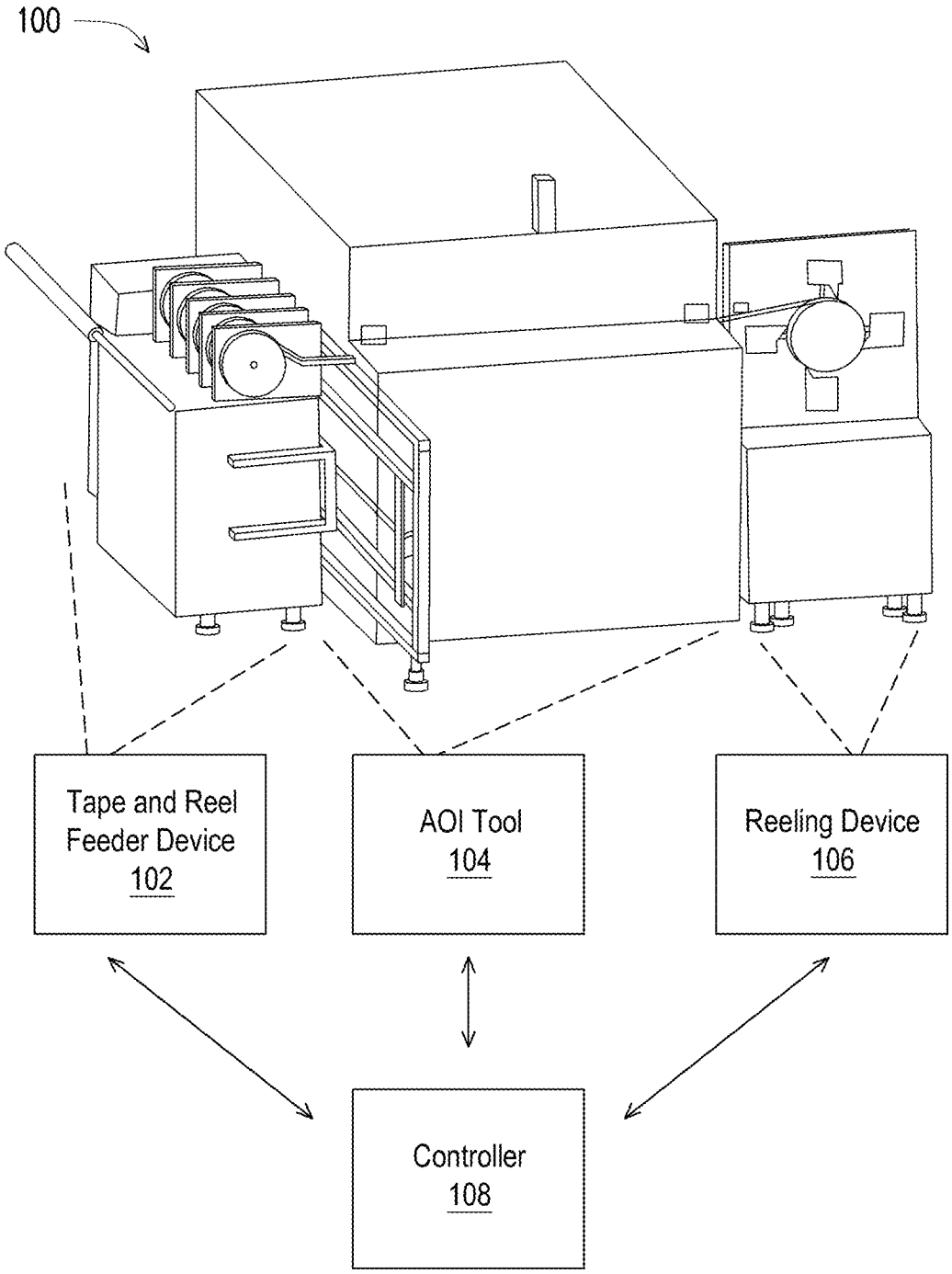
FIG. 1 is a diagram of an inspection system in which systems and/or methods described herein may be implemented.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "inner," "outer," "inward," and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

To operate a system that includes a loaded reel, an AOI tool, and an empty reel to receive tape when unloaded from the loaded reel, an operator may manually install the loaded reel at an in-port side of the AOI tool and may install the empty reel at an out-port side of the AOI tool. The operator may manually pull tape out of the loaded reel and through the AOI tool. The operator may feed the tape into the empty reel and attach the tape to the empty reel. The operator may then operate the AOI tool to inspect IC chips and/or dies on the tape until the tape is unloaded from the loaded reel and wound around the empty reel. After operating the AOI tool, the operator may manually unwind the tape from the empty reel (now loaded with the tape) until the tape is wrapped around the loaded reel again. However, manual installation and/or operation may cause the tape to be uncentered on the empty reel, cause jamming, increase operation delays, and/or the like.

Some implementations described herein provide techniques and apparatuses of an inspection system that uses a reeling device to automatically receive material (e.g., tape) that is unwound from a loaded reel. The reeling device may include a reel coupled to a motor (e.g., a motor that includes the reel, a motor and a reel that is removable, and/or the like), one or more guiding blocks, one or more tracks (e.g., slides) through which the one or more guiding blocks may travel generally towards or away from the reel, a force application device (e.g., a spring) to cause the one or more guiding blocks to travel though the one or more tracks or to resist travel through the one or more tracks, and/or the like.

In some implementations, the one or more guiding blocks may be configured with an opening at a receiving end and may have inner surfaces (e.g., proximate to the reel) configured to guide a received material (e.g., tape) on a path around a surface of the reel. In some implementations, the inner surfaces of the one or more guiding blocks may be arc-shaped to generally follow the surface of the reel.

The inner surfaces of the one or more guiding blocks may be spaced with different distances from a surface of the reel (e.g., when the reel is unloaded). In some implementations, the one or more guiding blocks may be arranged such that a first guiding block, that is first along a path around the surface of the reel, has an inner surface at a first distance from the reel. A second guiding block that is second along the path around the surface of the reel may have an inner surface at a second distance, with the second distance being less than the first distance. In some implementations, one or more guiding blocks along the path around the surface of the reel have inner surfaces that are progressively closer to the reel. In this way, respective inner surfaces of the one or more guiding blocks may collectively form a generally spiral-shaped path around the reel.

Based on using the reeling device as described herein, the reel may receive the material from a source reel without an operator manually feeding the material into the reel and/or attaching the material to the reel before operating the AOI tool. Additionally, or alternatively, the reeling device may improve centering of the material on the reel, reduce jamming, reduce operation delays, and/or the like, any or all of which improve operation of the inspection system.

FIG. 1 is a diagram of an inspection system 100 in which systems and/or methods described herein may be implemented. As shown in FIG. 1, inspection system 100 may include a tape and reel feeder device 102, an AOI tool 104, a reeling device 106, and a controller 108.

The tape and reel feeder device 102 may be configured to store, wind, and/or unwind material (e.g., tape with IC devices and/or dies) from one or more loaded reels. In some implementations, the tape and reel feeder device 102 may be configured to automatically feed material from one or more loaded reels stored thereon. For example, the tape and reel feeder device 102 may be configured to unload a first tape from a first loaded reel, receive (e.g., reload) the first tape back onto the first loaded reel (e.g., after optical inspection), then repeat the process with a second tape loaded on a second loaded reel. In some implementations, the tape and reel feeder device 102 may be loaded with a plurality of loaded reels and may be configured to automatically unload and load tapes thereon in series. The tape and reel feeder device 102 will be described in further detail in connection with FIG. 4.

The AOI tool 104 may be a tool that uses a camera or other optical device to inspect components. For example, the AOI tool 104 may be configured to inspect IC devices and/or dies on material as the material is delivered through an inspection area. The AOI tool 104 may inspect for defects in the IC devices and/or dies, such as misplacement of sub-components, soldering defects, and/or the like.

The reeling device 106 may be configured to receive material (e.g., tape) from the tape and reel feeder device 102 onto a rotation component or onto a reel coupled to the rotation component. For example, the reeling device 106 may be configured to receive material from the tape and reel feeder device 102 after inspection by the AOI tool 104.

In some implementations, the reeling device 106 may be configured to receive the material, load the material onto a reel, and then unload the material back to a source reel (e.g., a previously loaded reel). In some implementations, the reeling device 106 may be configured to receive the material to load onto a removable reel (e.g., for tape and reel packing). The reeling device 106 may be configured to receive a first material (e.g., a first tape) from a first loaded reel from the tape and reel feeder, load the first material onto a reel, unload the first material from the reel onto the first loaded reel, receive a second material from a second loaded reel from the tape and reel feeder device, load the second material onto the reel, unload the second material from the reel onto the second loaded reel, and so on. In some implementations, the reeling device 106 may be configured to automatically receive and unload material associated with multiple loaded reels in series. The reeling device 106 will be described in further detail in connection with FIGS. 2A-3D.

The controller 108 may include one or more interfaces for providing power and/or control signals to the tape and reel feeder device 102, the AOI tool 104, and/or the reeling device 106, among other devices. In some implementations, the controller 108 may be configured to receive input from an operator, the tape and reel feeder device 102, the AOI tool 104, and/or the reeling device 106, among other examples. For example, the controller 108 may receive an input (e.g., from an operator, and/or the tape and reel feeder device 102, among other examples) that indicates that a loaded reel of the tape and reel feeder device 102 is ready to be unloaded and may provide power and/or a control signal to the reeling device 106 to operate a motor in a loading operation mode.

The number and arrangement of devices shown in FIG. 1 are provided as one or more examples. In practice, there may be additional devices, fewer devices, different devices, or differently arranged devices than those shown in FIG. 1. Furthermore, two or more devices shown in FIG. 1 may be implemented within a single device, or a single device shown in FIG. 1 may be implemented as multiple, distributed devices. Additionally, or alternatively, a set of devices (e.g., one or more devices) of inspection system 100 may perform one or more functions described as being performed by another set of devices of inspection system 100.

FIGS. 2A-2F are diagrams of an example of a reeling device 106, described herein. A process of loading material onto a reel and/or a rotation component of the reeling device 106 may include one or more operations described with respect to FIGS. 2A-2F.

Figure 2A:
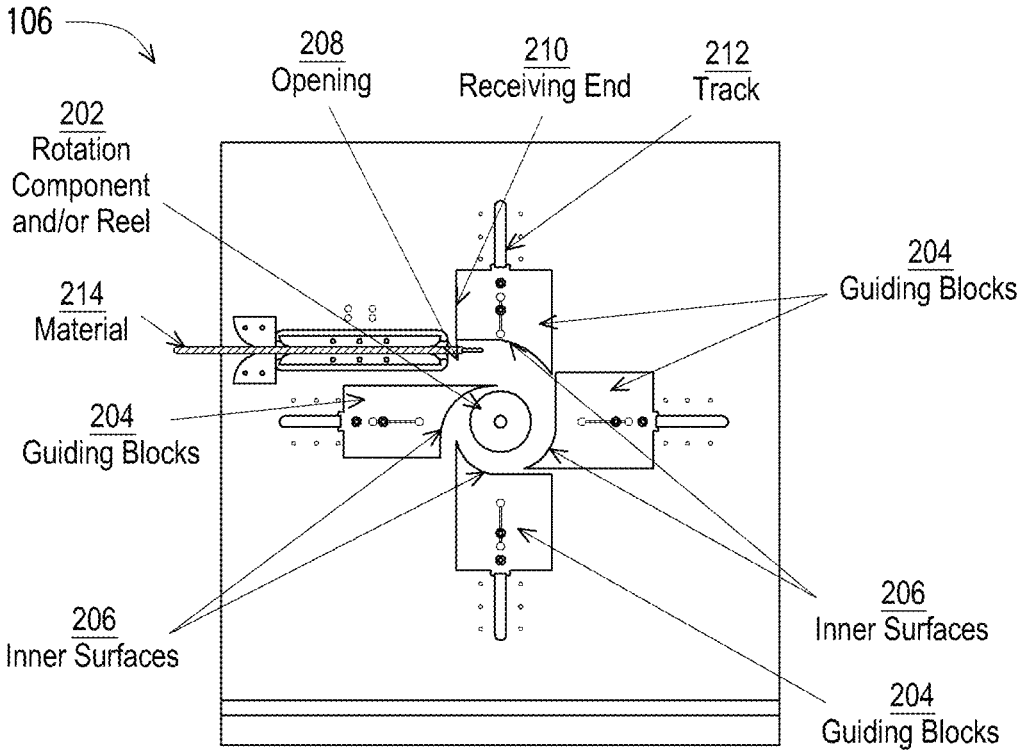
FIGS. 2A-2F are diagrams of one or more example implementations described herein.

As shown by FIG. 2A, the reeling device 106 may include a rotation component and/or reel 202. In some implementations, the rotation component and/or reel 202 may include a reel that is coupled to a motor (e.g., shown in FIG. 3B) and configured to rotate when the motor is in operation. In some implementations, the rotation component may be integrated with the motor. In some implementations, the rotation component may be used in combination with the reel (e.g., with the reel fixed to the rotation component) or the rotation component may be used as a substitute for the reel (e.g., to receive material directly on the rotation component).

The reeling device 106 may include guiding blocks 204 (e.g., a plurality of guiding blocks) positioned around the rotation component and/or reel 202. For example, the guiding blocks 204 may be angularly spaced around the rotation component and/or reel 202. The guiding blocks 204 may include inner surfaces 206 (e.g., proximate to the rotation component and/or reel 202) that are configured to guide a received material on a path around a surface of the rotation component and/or reel 202. The inner surfaces 206 may be arc-shaped to generally follow the surface of the rotation component and/or reel 202. In some implementations, respective inner surfaces 206 may be configured to guide received material on a generally spiral-shaped path around the rotation component and/or reel 202.

In some implementations, guiding blocks of the guiding blocks 204 may be positioned at different distances from the surface of the reel when the reel is unloaded. Additionally, or alternatively, the guiding blocks 204 may be positioned at different distances from the surface of the reel when the reel is unloaded and/or during an unloading operation or a loading operation. The guiding blocks 204 may be configured with an opening 208 at a receiving end 210. In some implementations, the opening 208 may be configured to receive material for loading on the rotation component and/or reel 202.

The reeling device 106 may include tracks 212 (e.g., one or more slides) along which the guiding blocks 204 are configured to travel generally towards, or generally away from, the surface of the rotation component and/or reel 202. The guiding blocks 204 may be coupled to the tracks 212. In some implementations, the tracks 212 may permit radially inward and radially outward movement by the guiding blocks 204. In some implementations, force application devices (e.g., shown in FIG. 3B) may be configured to apply force on the guiding blocks 204 in radially inward directions that are generally towards the rotation component and/or reel 202. In this way, the force application devices may urge the guiding blocks 204 to travel in radially inward directions. However, force applied by the force application devices may be overcome by a force in a radially outward direction (e.g., force applied by received material when loading the rotation component and/or reel 202 as the received material winds around the rotation component and/or reel 202).

The reeling device 106 may receive material 214 via the opening 208 at, or proximate to, the receiving end 210 of the guiding blocks 204. For example, the reeling device 106 may receive the material 214 after optical inspection, as described with reference to FIG. 1. In some implementations, the material 214 may include a tape that carries one or more IC devices and/or dies.

Figure 2B:
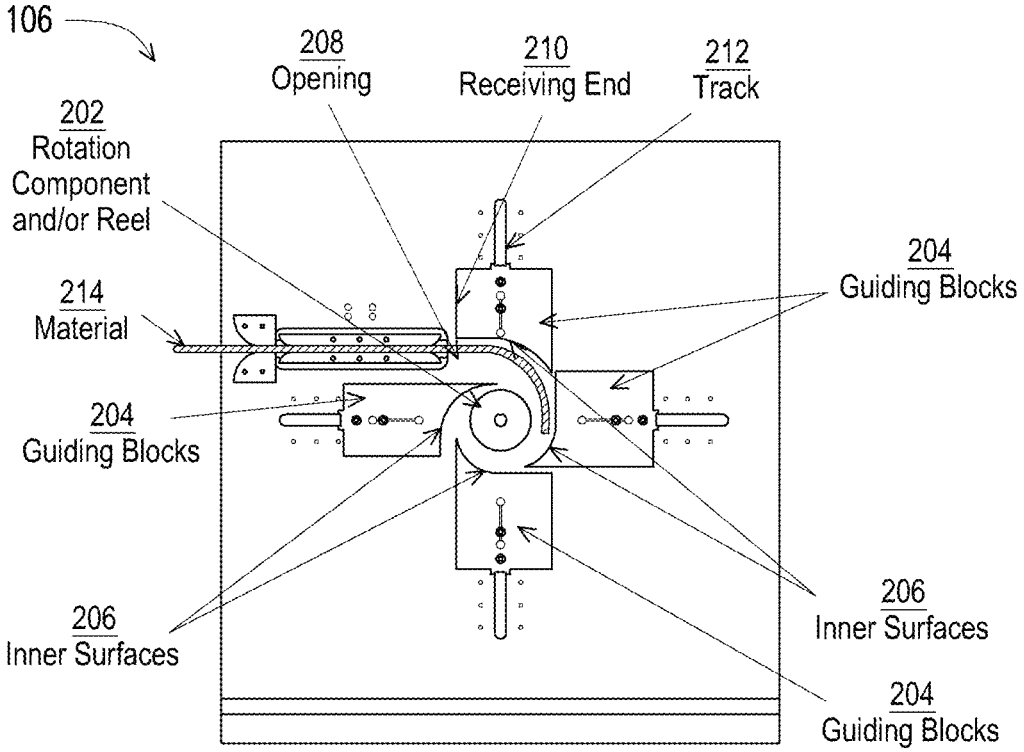

As shown by FIG. 2B, the reeling device 106 may receive the material 214 along a path around the surface of the rotation component and/or reel 202. In some implementations, a first guiding block 204 (e.g., a guiding block proximate to the receiving end 210) may begin guidance of the material 214 along the path around the surface of the rotation component and/or reel 202 using an inner surface 206 to urge the material 214 towards a second guiding block 204. In some implementations, the first guiding block 204 may guide the material 214 through a first angle of rotation around the rotation component and/or reel 202.

Figure 2C:
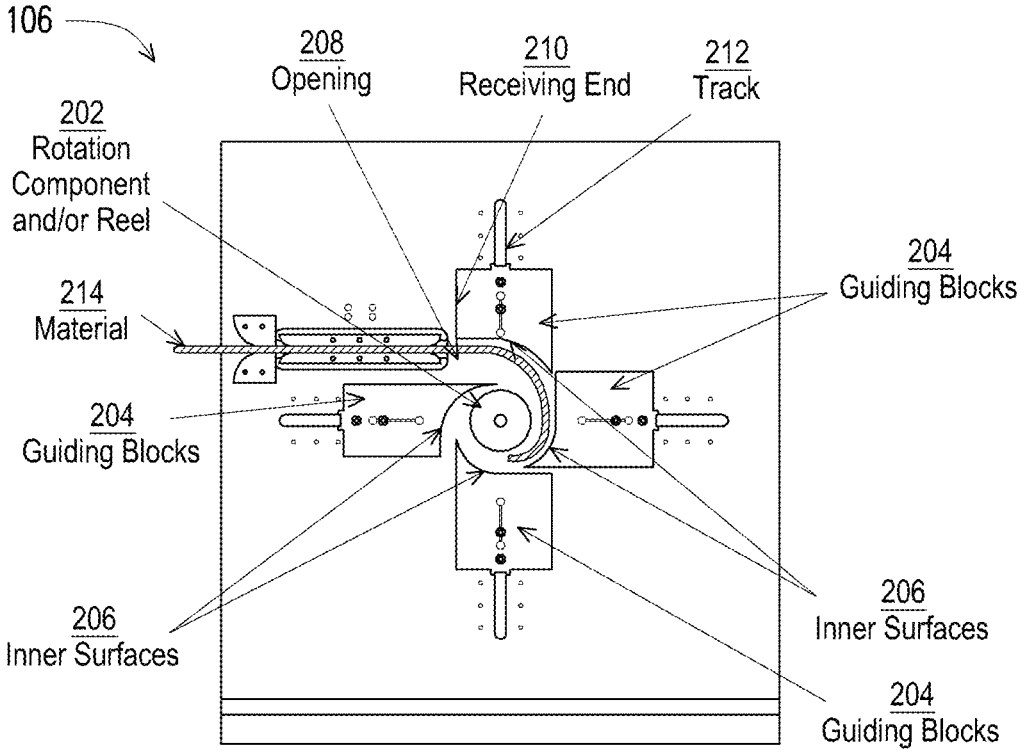

As shown by FIG. 2C, the second guiding block 204 may guide the material 214 farther along the path around the surface of the rotation component and/or reel 202. In some implementations, the second guiding block 204 (e.g., a guiding block adjacent to the first guiding block 204 in a direction along the path around the surface of the rotation component and/or reel 202) may guide the material 214 farther along the path around the surface of the rotation component and/or reel 202 using an inner surface 206 to urge the material 214 towards a third guiding block 204. In some implementations, the second guiding block 204 may guide the material 214 though a second angle of rotation around the rotation component and/or reel 202.

Figure 2D:
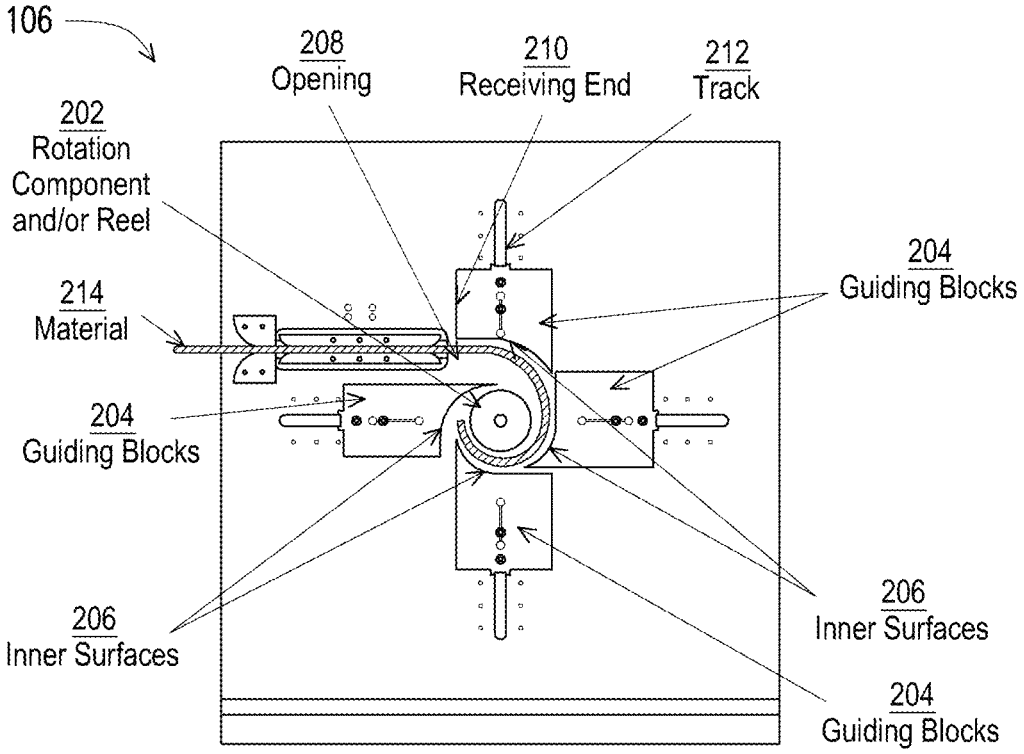

As shown by FIG. 2D, the third guiding block 204 may guide the material 214 farther along the path around the surface of the rotation component and/or reel 202. In some implementations, the third guiding block 204 (e.g., a guiding block adjacent to the second guiding block in a direction along the path around the surface of the rotation component and/or reel 202) may guide the material 214 farther along the path around the surface of the rotation component and/or reel 202 using an inner surface 206 to urge the material 214 towards a fourth guiding block 204. In some implementations, the third guiding block 204 may guide the material 214 though a third angle of rotation around the rotation component and/or reel 202.

Figure 2E:
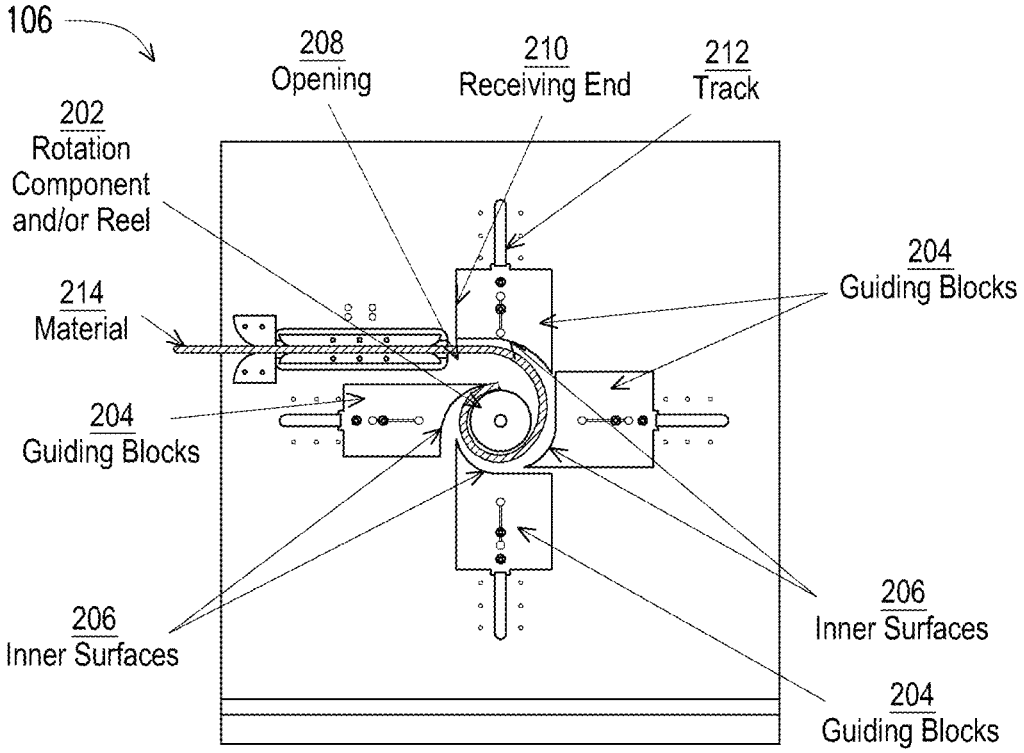

As shown by FIG. 2E, the fourth guiding block 204 may guide the material 214 farther along the path around the surface of the rotation component and/or reel 202. In some implementations, the fourth guiding block 204 (e.g., a guiding block adjacent to the third guiding block in a direction along the path around the surface of the rotation component and/or reel 202) may guide the material 214 farther along the path around the surface of the rotation component and/or reel 202 using an inner surface 206 to urge the material 214 towards the first guiding block 204. In some implementations, the fourth guiding block 204 may guide the material 214 though a fourth angle of rotation around the rotation component and/or reel 202. In some aspects, the guiding blocks 204 may be spaced such that a sum of the first angle, the second angle, the third angle, and the fourth angle is less than or equal to 360 degrees.

Figure 2F:
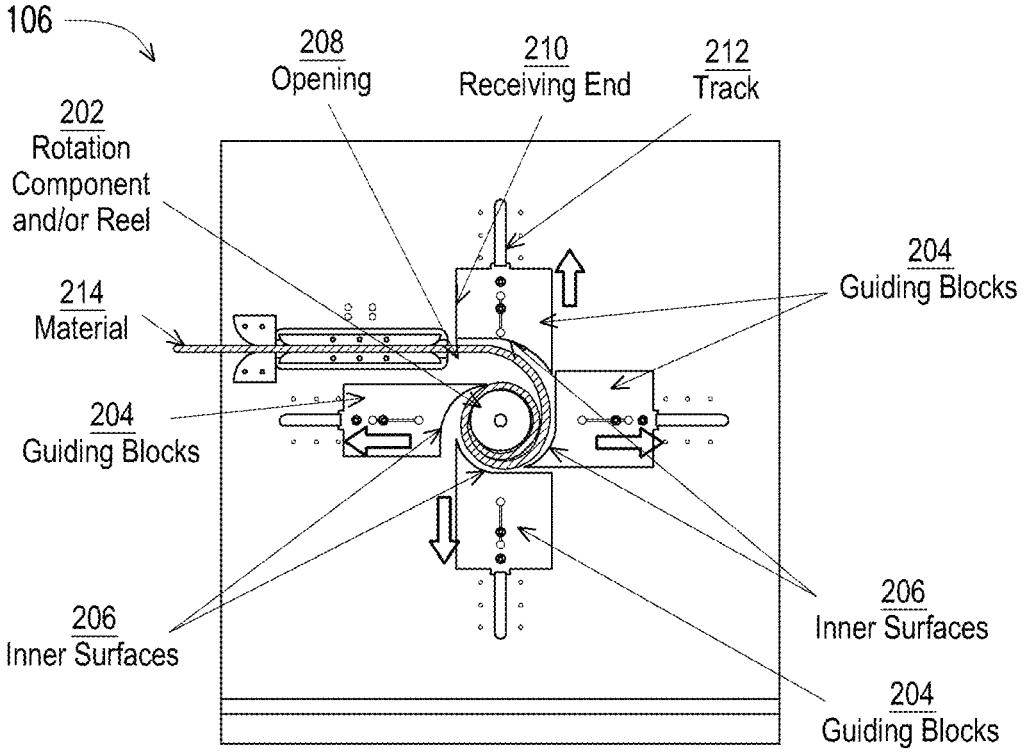

As shown by FIG. 2F, the material 214 may be loaded onto the rotation component and/or reel 202. In some implementations, loading the material 214 onto the rotation component and/or reel 202 may overcome the radially inward force of the force application devices and may urge the guiding blocks 204 along the tracks 212 in radially outward directions that are generally away from the rotation component and/or reel 202. In some implementations, the guiding blocks 204 may provide a compressive force onto the material 214 to press the material 214 against the rotation component and/or reel 202.

In some implementations, the guiding blocks 204 may be configured to travel generally away from the surface of the rotation component and/or reel 202 when loading the rotation component and/or reel 202 with the material 214. Additionally, or alternatively, the guiding blocks 204 may be configured to travel generally towards the surface of the rotation component and/or reel 202 when unloading the rotation component and/or reel 202 with the material 214.

The number and arrangement of structures, layers, and/or the like shown in FIGS. 2A-2F are provided as an example. In practice, a reeling device 106 including additional components (e.g., additional guiding blocks 204), fewer components (e.g., fewer guiding blocks 204), different components, or differently arranged components than those shown in FIGS. 2A-2F may operate according to the techniques described above in connection with FIGS. 2A-2F.

FIGS. 3A-3D are diagrams of one or more example reeling devices 106 described in connection with FIGS. 2A-2F. As shown by a front view of the reeling device 106 in FIG. 3A, the reeling device 106 may include the rotation component and/or reel 202, the guiding blocks 204, the inner surfaces 206, the opening 208, the receiving end 210, the tracks 212, and/or the like.

Figure 3A:
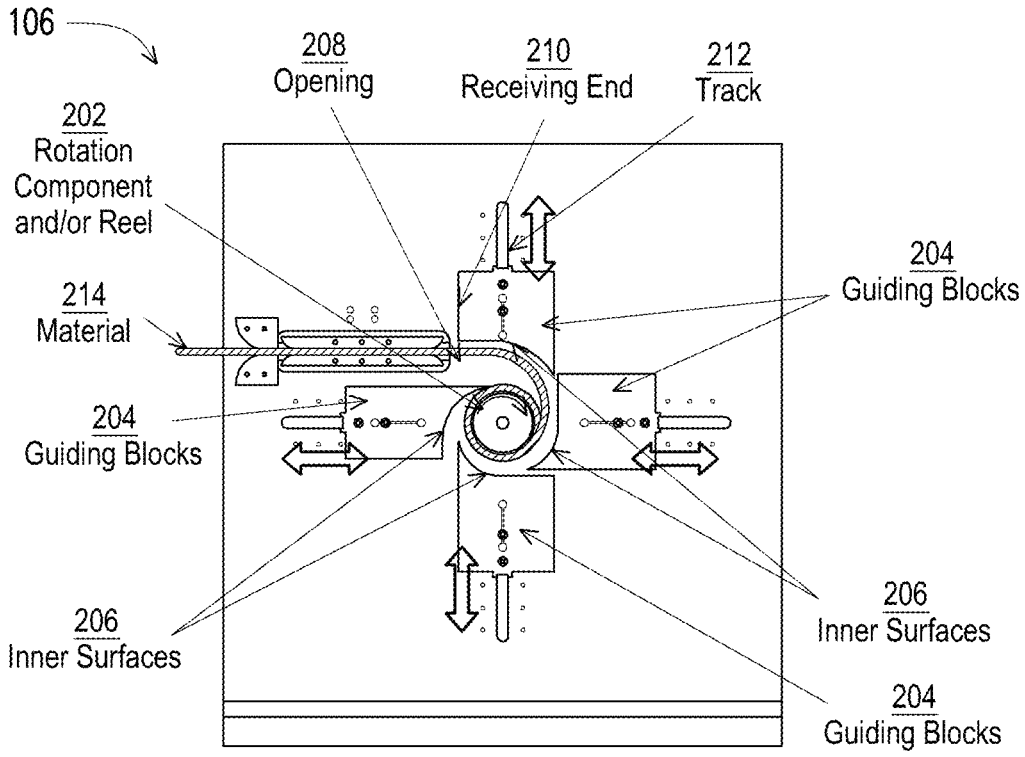
FIGS. 3A-3D are diagrams of one or more example reeling devices described in connection with FIGS. 2A-2F.
Figure 3B:
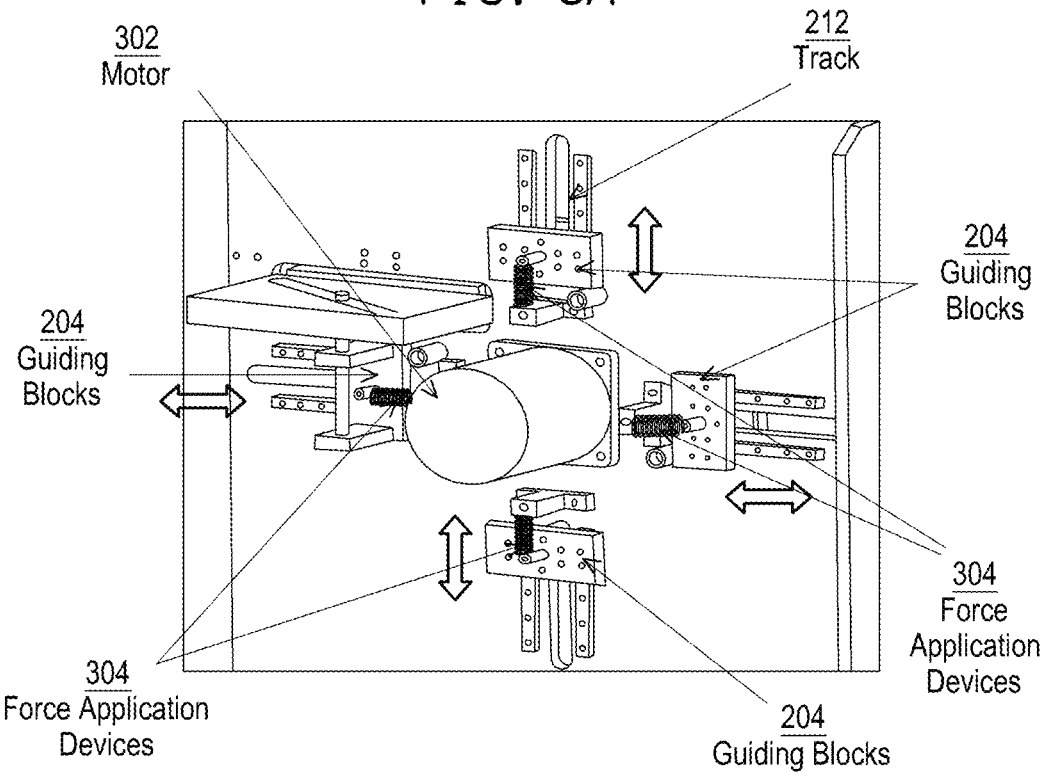

As shown by a back view of the reeling device 106 in FIG. 3B, the reeling device 106 may also include a motor 302 and/or force application devices 304. The motor 302 may include a rotation component (e.g., of the rotation component and/or a reel 202) that is configured to rotate when the motor 302 is in operation. For example, when in a loading operation mode, the motor 302 may be configured to rotate the rotation component and/or reel 202 in a clockwise direction (as viewed from the front view of FIG. 3A) and may be configured to rotate the rotation component and/or reel 202 in a counter-clockwise direction when in an unloading operation mode.

In some implementations, the force application devices 304 may be configured to apply force on the guiding blocks 204 in one or more radially inward directions that are generally towards the rotation component and/or reel 202, the motor 302, and/or an axis of rotation of the rotation component and/or reel 202. In some implementations, the force application devices 304 may include one or more springs configured to apply force on one or more of the guiding blocks 204. In this way, the guiding blocks 204 may apply pressure on the material 214 that is loaded and/or wound onto the rotation component and/or reel 202.

Figure 3C:
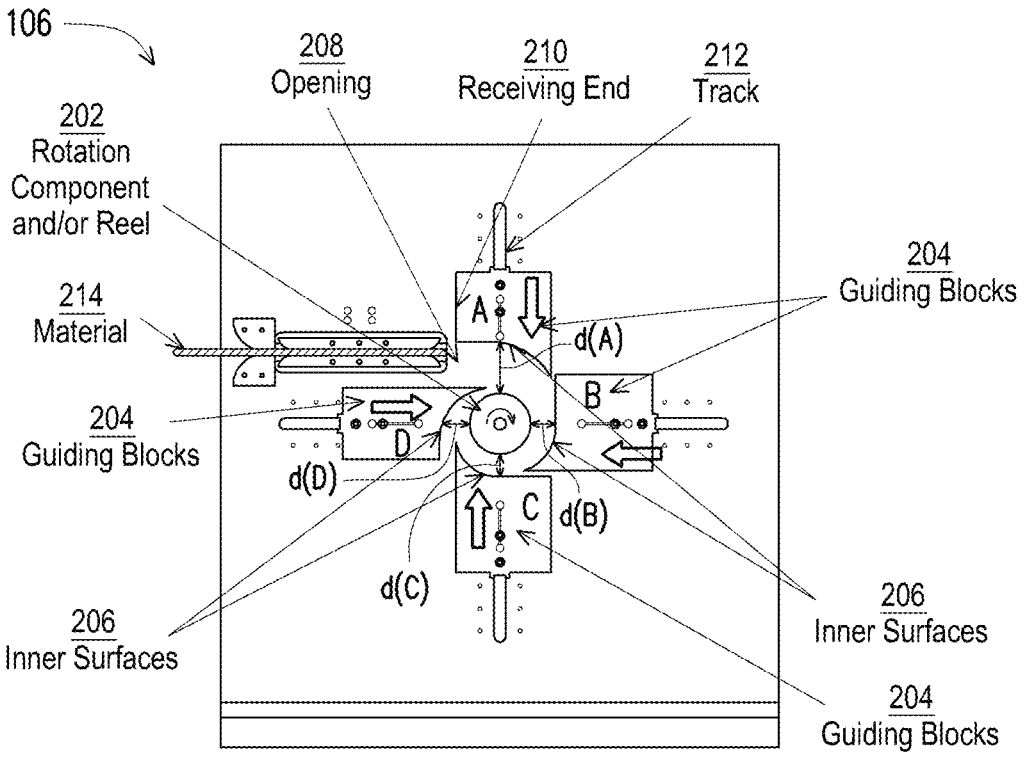

As shown by FIG. 3C, the reeling device 106 may be configured with the guiding blocks 204 positioned at different distances from the surface of the rotation component and/or the reel 202. For example, a first guiding block 204, that is adjacent to the opening 208, may be positioned at a first distance d(A) from the surface of the rotation component and/or reel 202. A second guiding block 204, that is adjacent to the first guiding block 204, may be positioned at a second distance d(B) from the surface of the rotation component and/or reel 202, with the first distance d(A) greater than the second distance d(B).

A third guiding block 204, that is adjacent to the second guiding block 204, may be positioned at a third distance d(C) from the surface of the rotation component and/or reel 202, with the second distance d(B) greater than the third distance d(C). A fourth guiding block 204, that is adjacent to the third guiding block 204, may be positioned at a fourth distance d(D) from the surface of the rotation component and/or reel 202, with the third distance greater d(C) than the fourth distance d(D). In some implementations, each of the guiding blocks 204 along the path around the surface of the rotation component and/or reel 202 (e.g., oriented with the opening 208 as the beginning of the path) may be progressively closer to the surface of the rotation component and/or reel 202. In this way, the guiding blocks 204, and the inner surfaces 206 of the guiding blocks 204, may form (e.g., collectively) a generally spiral-shaped path around the rotation component and/or reel 202.

Figure 3D:
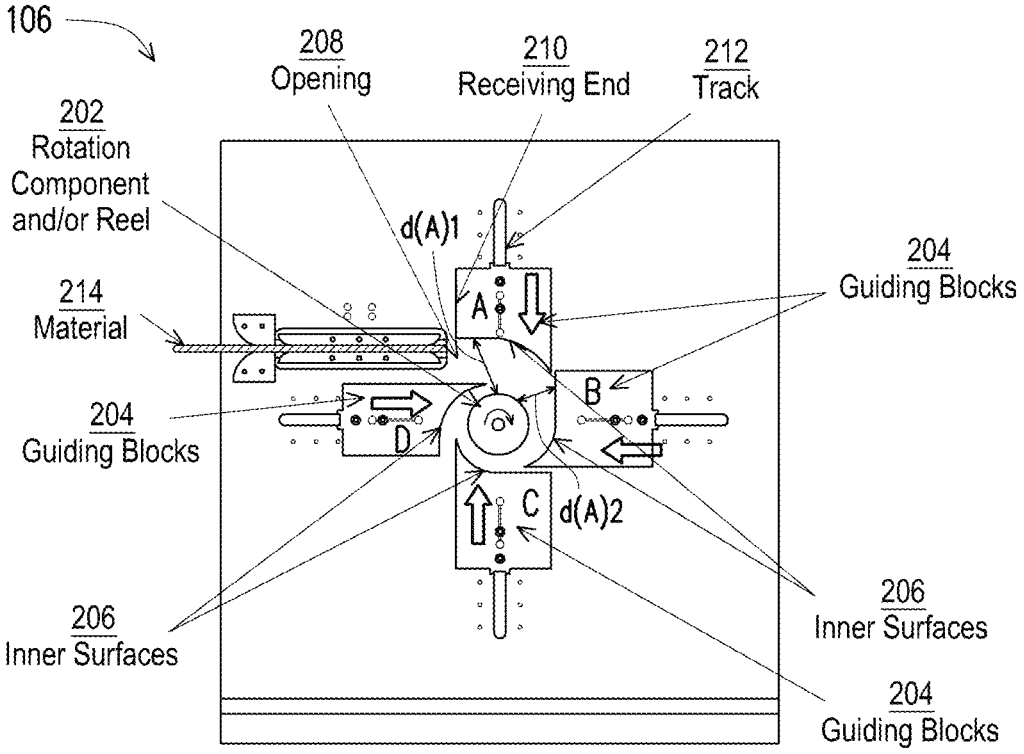

As shown by FIG. 3D, at least one of the guiding blocks 204 may be configured with an inner surface 206 that is positioned with a first end at a first distance d(A)1 from the surface of the rotation component and/or reel 202 and a second end at a second distance d(A)2 from the surface of the rotation component and/or reel 202, wherein the first end is proximate to (e.g., closer to) the opening 208 along the path around the surface of the rotation component and/or reel 202 and the second end is distal from (e.g., farther from) the opening 208 along the path around the surface of the rotation component and/or reel 202. The first distance d(A)1 may be greater than the second distance d(A)2 such that a portion of the path around the rotation component and/or reel 202 that is provided by the inner surface 206 may form a portion of a spiral.

The number and arrangement of structures, layers, and/or the like shown in FIGS. 3A-3D are provided as an example. In practice, a reeling device 106 including additional components (e.g., additional guiding blocks 204), fewer components (e.g., fewer guiding blocks 204), different components, or differently arranged components than those shown in FIGS. 3A-3D may be operate according to the techniques described above in connection with FIGS. 3A-3D.

Figure 4:
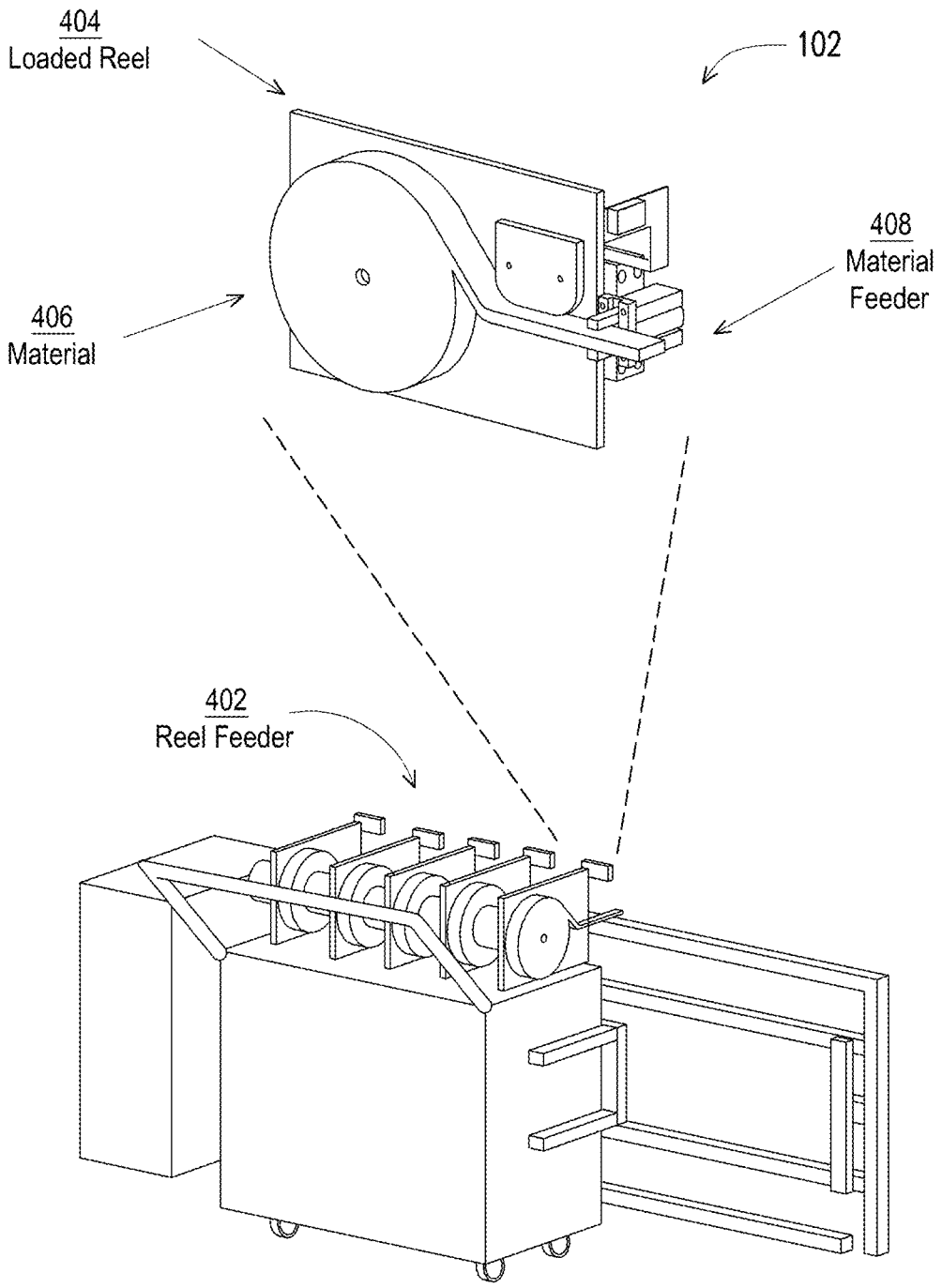
FIG. 4 is a diagram of an example tape and reel feeder device described in connection with FIG. 1.

FIG. 4 is a diagram of an example tape and reel feeder device 102 described in connection with FIG. 1. The tape and reel feeder device 102 may include a reel feeder 402 that is configured with multiple loaded reels 404. The loaded reels may be loaded with material 406.

The tape and reel feeder device 102 may further include a material feeder 408 that feeds the material 406 to the AOI tool 104 and/or the reeling device 106. In some implementations, the material feeder 408 may be configured to receive power and/or control signals from the controller 108 to operate in a loading operation mode or an unloading operation mode.

In some implementations, the tape and reel feeder device 102 may be configured to automatically feed tape from one or more loaded reels 404 configured for use with the AOI tool 104. For example, the tape and reel feeder device 102 may be configured to unload a first material 406 from a first loaded reel 404, receive (e.g., reload) the first tape back onto the first loaded reel 404 (e.g., after optical inspection), and then repeat the process with a second material 406 loaded on a second loaded reel 404. In some implementations, the tape and reel feeder device 102 may be loaded with a plurality of loaded reels 404 and may be configured to automatically unload and load tape thereon as part of an optical inspection operation.

As indicated above, FIG. 4 is provided as an example. Other examples may differ from what is described with regard to FIG. 4.

Figure 5:
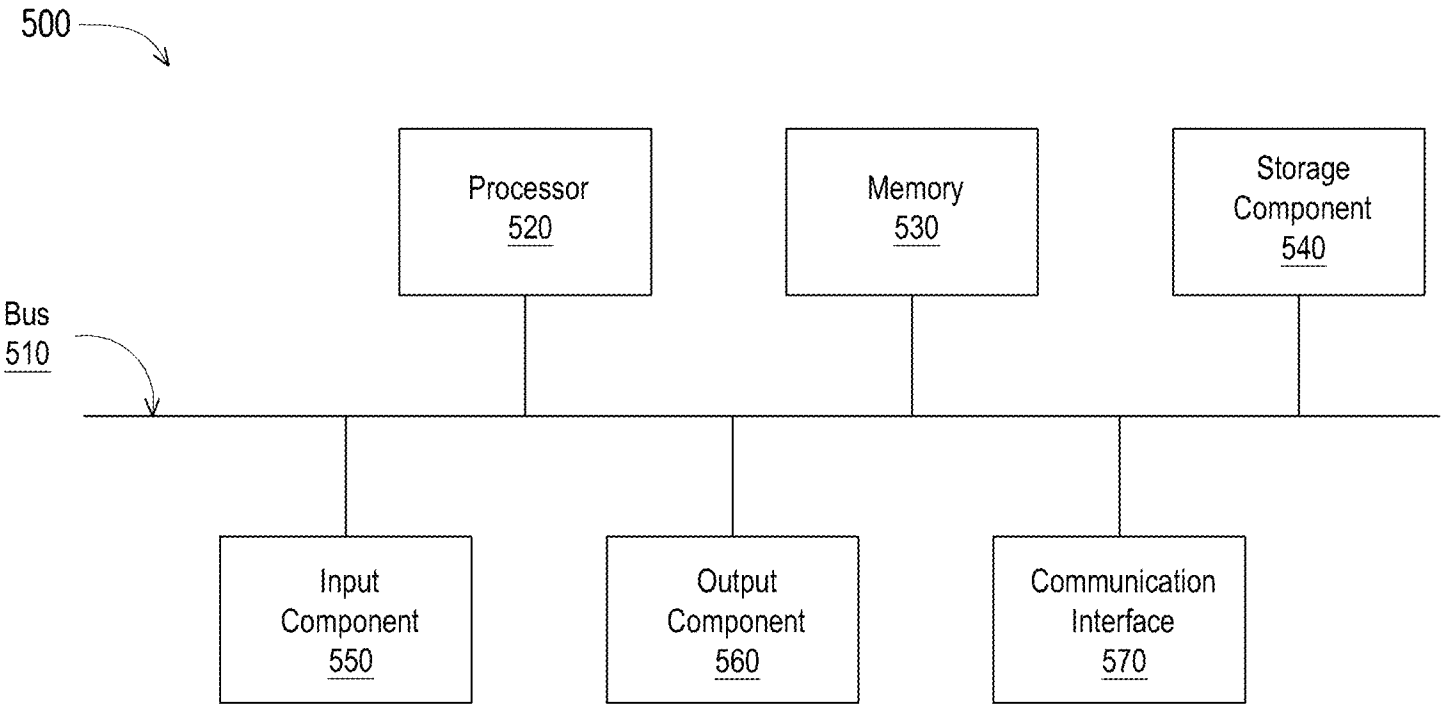
FIG. 5 is a diagram of example components of one or more devices of FIG. 1.

FIG. 5 is a diagram of example components of a device 500, which may correspond to the tape and reel feeder device 102, the AOI tool 104, the reeling device 106, and/or the controller 108. In some implementations, the tape and reel feeder device 102, the AOI tool 104, the reeling device 106, and/or the controller 108 may include one or more devices 500 and/or one or more components of device 500. As shown in FIG. 5, device 500 may include a bus 510, a processor 520, a memory 530, a storage component 540, an input component 550, an output component 560, and a communication component 570.

Bus 510 includes a component that enables wired and/or wireless communication among the components of device 500. Processor 520 includes a central processing unit, a graphics processing unit, a microprocessor, a controller, a microcontroller, a digital signal processor, a field-programmable gate array, an application-specific integrated circuit, and/or another type of processing component. Processor 520 is implemented in hardware, firmware, or a combination of hardware and software. In some implementations, processor 520 includes one or more processors capable of being programmed to perform a function. Memory 530 includes a random access memory, a read only memory, and/or another type of memory (e.g., a flash memory, a magnetic memory, and/or an optical memory).

Storage component 540 stores information and/or software related to the operation of device 500. For example, storage component 540 may include a hard disk drive, a magnetic disk drive, an optical disk drive, a solid state disk drive, a compact disc, a digital versatile disc, and/or another type of non-transitory computer-readable medium. Input component 550 enables device 500 to receive input, such as user input and/or sensed inputs. For example, input component 550 may include a touch screen, a keyboard, a keypad, a mouse, a button, a microphone, a switch, a sensor, a global positioning system component, an accelerometer, a gyroscope, an actuator, and/or the like. Output component 560 enables device 500 to provide output, such as via a display, a speaker, and/or one or more light-emitting diodes. Communication component 570 enables device 500 to communicate with other devices, such as via a wired connection and/or a wireless connection. For example, communication component 570 may include a receiver, a transmitter, a transceiver, a modem, a network interface card, an antenna, and/or the like.

Device 500 may perform one or more processes described herein. For example, a non-transitory computer-readable medium (e.g., memory 530 and/or storage component 540) may store a set of instructions (e.g., one or more instructions, code, software code, program code, and/or the like) for execution by processor 520. Processor 520 may execute the set of instructions to perform one or more processes described herein. In some implementations, execution of the set of instructions, by one or more processors 520, causes the one or more processors 520 and/or the device 500 to perform one or more processes described herein. In some implementations, hardwired circuitry may be used instead of or in combination with the instructions to perform one or more processes described herein. Thus, implementations described herein are not limited to any specific combination of hardware circuitry and software.

The number and arrangement of components shown in FIG. 5 are provided as an example. Device 500 may include additional components, fewer components, different components, or differently arranged components than those shown in FIG. 5. Additionally, or alternatively, a set of components (e.g., one or more components) of device 500 may perform one or more functions described as being performed by another set of components of device 500.

Figure 6:
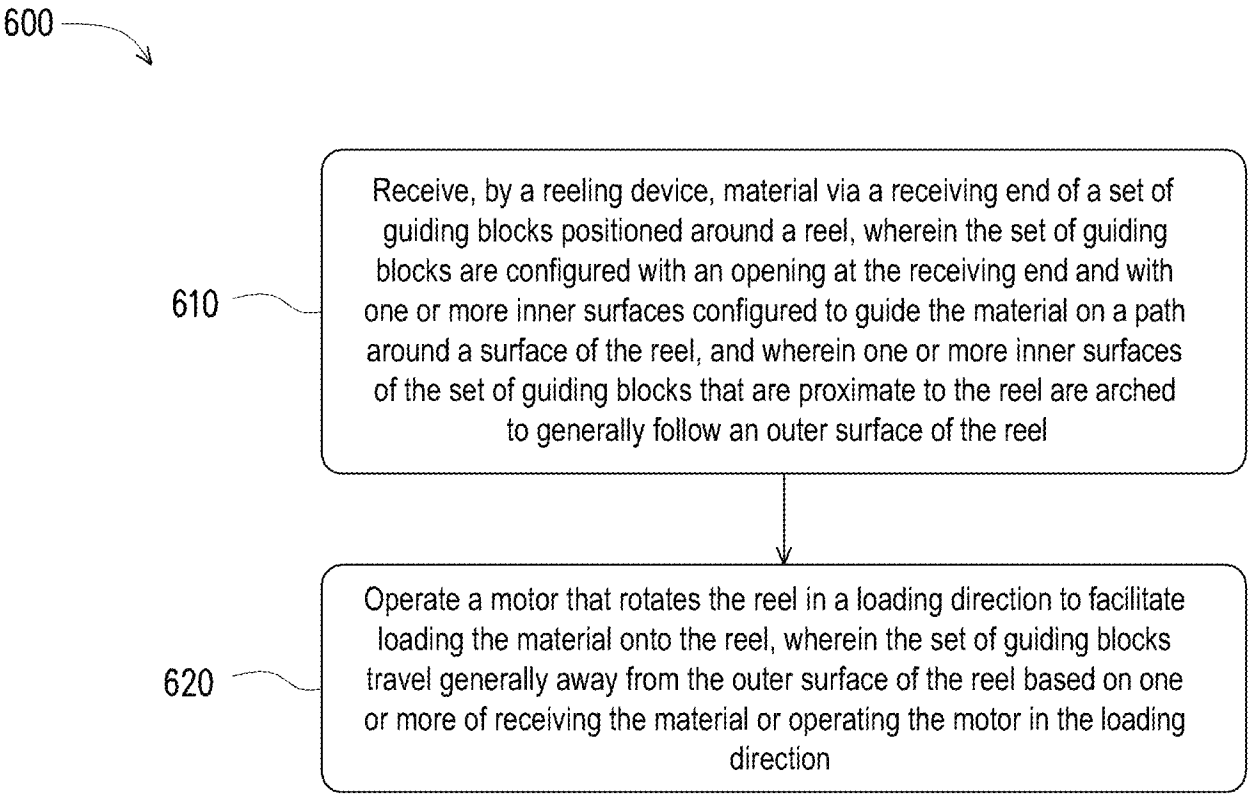
FIG. 6 is a flowchart of an example process relating to using an integrated circuit tape and reel reeling device.

FIG. 6 is a flowchart of an example process 600 associated with using an integrated circuit tape and reel reeling device. In some implementations, one or more process blocks of FIG. 6 may be performed by a reeling device (e.g., reeling device 106). In some implementations, one or more process blocks of FIG. 6 may be performed by another device or a group of devices separate from or including the reeling device, such as a controller (e.g., controller 108), a tape and reel feeder device (e.g., the tape and reel feeder device 102), and/or an AOI tool (e.g., the AOI tool 104). Additionally, or alternatively, one or more process blocks of FIG. 6 may be performed by one or more components of device 500, such as processor 520, memory 530, storage component 540, input component 550, output component 560, and/or communication component 570.

As shown in FIG. 6, process 600 may include receiving material via a receiving end of a set of guiding blocks positioned around a reel, wherein the set of guiding blocks are configured with an opening at the receiving end and with one or more inner surfaces configured to guide the material on a path around a surface of the reel, and wherein the one or more inner surfaces of the set of guiding blocks are arc-shaped to generally follow the surface of the reel (block 610). For example, the reeling device 106 may receive material via a receiving end 210 of a set of guiding blocks 204 positioned around a reel 202, as described above. In some implementations, the set of guiding blocks 204 are configured with an opening 208 at the receiving end 210 and with one or more inner surfaces 206 configured to guide the material 214 on a path around a surface of the reel 202. In some implementations, the one or more inner surfaces 206 of the set of guiding blocks 204 are arc-shaped to generally follow the surface of the reel 202.

As further shown in FIG. 6, process 600 may include operating a motor that rotates the reel in a loading direction to facilitate loading the material onto the reel, wherein the set of guiding blocks travel generally away from the surface of the reel based on one or more of the material being received or the motor operating in the loading direction (block 620). For example, the reeling device may operate a motor 302 that rotates the reel 202 in a loading direction to facilitate loading the material 214 onto the reel 202, as described above. In some implementations, the set of guiding blocks 204 travel generally away from the surface of the reel 202 based on one or more of the material 214 being received or the motor 302 operating in the loading direction.

Process 600 may include additional implementations, such as any single implementation or any combination of implementations described below and/or in connection with one or more other processes described elsewhere herein.

In a first implementation, process 600 includes operating the motor in an unloading direction to facilitate unloading the material from the reel, wherein the set of guiding blocks travel generally towards the surface of the reel based on one or more of the material being unloaded or the motor operating in the unloading direction.

In a second implementation, alone or in combination with the first implementation, one or more guiding blocks of the set of guiding blocks travel generally away from the surface of the reel via one or more tracks.

In a third implementation, alone or in combination with one or more of the first and second implementations, a set of force application devices apply force to resist the set of guiding blocks traveling generally away from the surface of the reel.

In a fourth implementation, alone or in combination with one or more of the first through third implementations, the set of force application devices comprises one or more springs.

In a fifth implementation, alone or in combination with one or more of the first through fourth implementations, the path around the surface of the reel is a generally spiral-shaped path.

Although FIG. 6 shows example blocks of process 600, in some implementations, process 600 may include additional blocks, fewer blocks, different blocks, or differently arranged blocks than those depicted in FIG. 6. Additionally, or alternatively, two or more of the blocks of process 600 may be performed in parallel.

Based on using a reeling device as described herein (e.g., the reeling device 106), a rotation component and/or a reel 202 (e.g., the rotation component and/or reel 202) may receive material (e.g., tape, the material 214, and/or the like) from a loaded reel (e.g., loaded reel 404) without an operator manually feeding the material into the reel and/or attaching the material to the reel before operating loading the material onto the reel (e.g., as part of an AOI process). Additionally, or alternatively, the reeling device may improve centering of the tape on the reel, reduce jamming, reduce operation delays, and/or the like.

As described in greater detail above, some implementations described herein provide techniques and apparatuses for using a reeling device to receive tape that is unwound from a loaded reel. The techniques and apparatuses may obviate a need to manually unwind the tape from the loaded real and attach the tape to a reel of the reeling device.

In some implementations, a reeling device includes a reel coupled to a motor and configured to rotate when the motor is in operation. The reeling device also includes a set of guiding blocks positioned around the reel. The set of guiding blocks are configured with an opening at a receiving end and having one or more inner surfaces configured to guide a received material on a path around a surface of the reel. The one or more inner surfaces of the set of guiding blocks that are proximate to the reel are arc-shaped to generally follow the surface of the reel. The reeling device further includes a set of force application devices configured to apply force on the set of guiding blocks in one or more radially inward directions that are generally towards the reel.

In some implementations, a reeling device includes a motor that includes a rotation component configured to rotate when the motor is in operation. The reeling device also includes a plurality of guiding blocks positioned around the rotation component. The plurality of guiding blocks are configured with an opening at respective receiving ends and have respective inner surfaces configured to guide a received material on a generally spiral-shaped path around the rotation component. The respective inner surfaces of the plurality of guiding blocks that are proximate to the rotation component are arc-shaped to collectively form the generally spiral-shaped path around the rotation component. The reeling device further includes a plurality of force application devices configured to apply force on the plurality of guiding blocks in radially inward directions that are generally towards the rotation component.

In some implementations, a method of reeling includes receiving, by a reeling device, material via a receiving end of a set of guiding blocks positioned around a reel. The set of guiding blocks are configured with an opening at the receiving end and with one or more inner surfaces configured to guide the material on a path around a surface of the reel. The one or more inner surfaces of the set of guiding blocks are arc-shaped to generally follow the surface of the reel. The method of reeling also includes operating a motor that rotates the reel in a loading direction to facilitate loading the material onto the reel. The set of guiding blocks travel generally away from the surface of the reel based on one or more of the material being received or the motor operating in the loading direction.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A device, comprising:

a reel configured to rotate;

a plurality of guiding blocks, positioned around the reel, configured with an opening at a receiving end between at least two of the plurality of guiding blocks, wherein each of the plurality of guiding blocks has an inner surface configured to guide a received material on a path around a surface of the reel, wherein the plurality of guiding blocks includes a first guiding block and a second guiding block, wherein an exterior surface of the first guiding block intersects with the inner surface of the second guiding block to provide the path around the surface of the reel; and a set of force application devices configured to apply force on the plurality of guiding blocks in one or more radially inward directions that are generally towards the reel.

2. The device of claim 1, wherein the inner surface of the plurality of guiding blocks are arc shaped.

3. The device of claim 1, wherein the plurality of guiding blocks are positioned at different positions from the surface of the reel when the reel is unloaded.

4. The device of claim 1, wherein the opening of the plurality of guiding blocks is configured to receive the received material after inspection by an automated optical inspection tool.

5. The device of claim 1, wherein the plurality of guiding blocks are positioned at different distances from the surface of the reel absent the received material on the reel.

6. A device, comprising:

a reel configured to rotate; and a set of guiding blocks, positioned around the reel, having an opening at a receiving end that defines a first point of contact for receiving a first tape, configured to:

receive the first tape after inspection by an automated optical inspection tool, load the reel with the first tape, and unload the first tape from the reel.

7. The device of claim 6, wherein the first tape is received from a tape and reel feeder.

8. The device of claim 6, wherein the set of guiding blocks are structured to guide the first tape onto the reel.

9. The device of claim 8, wherein the set of guiding blocks comprises curved inner surfaces.

10. The device of claim 6, further comprising:

a set of tracks through which the set of guiding blocks are configured to travel towards or away from the reel.

11. The device of claim 6, further comprising:

a set of force application devices configured to apply force on the guiding blocks to move radially inward towards the reel.

12. The device of claim 11, wherein the set of force application devices are configured to apply force on the guiding blocks to move radially inward towards the reel when the set of guiding blocks loads and unloads the first tape.

13. The device of claim 6, wherein one or more guiding blocks along a path around a surface of the reel, oriented with the opening at the receiving end as a beginning of the path, have inner surfaces that are progressively closer to the reel, such that the inner surfaces collectively form a generally spiral-shaped path around the reel.

14. A method, comprising:

operating a motor that rotates a reel; and loading a material onto the reel, or unloading the material from the reel, via:

an opening at a receiving end of curved inner surfaces of a set of guiding blocks positioned around the reel, and at least one of:

one or more tracks from which the guiding blocks are configured to travel towards or away from the reel, or a set of force application devices configured to apply force to resist the set of guiding blocks from traveling away from the reel.

15. The method of claim 14, wherein the loading or the unloading is performed via the one or more tracks.

16. The method of claim 14, wherein the loading or the unloading is performed via the set of force application devices.

17. The method of claim 16, wherein the set of force application devices comprises one or more springs.

18. The method of claim 14, wherein the motor is configured to operate in a first direction when the material is loaded onto the reel or in a second direction when the material unloaded from the reel.

19. The method of claim 14, wherein the curved inner surfaces define a path for the material around the reel.

20. The method of claim 19, wherein the path around the surface of the reel is a spiral-shaped path.

* * * * *